US009333670B2

(12) United States Patent
Pourney

(10) Patent No.: US 9,333,670 B2
(45) Date of Patent: May 10, 2016

(54) TREATMENT TANK FOR WOOD ARTICLES

(76) Inventor: Michael L. Pourney, Kirkwood, MO (US)

( * ) Notice: Subject to any disclaimer, the term of this patent is extended or adjusted under 35 U.S.C. 154(b) by 710 days.

(21) Appl. No.: 13/608,739

(22) Filed: Sep. 10, 2012

(65) Prior Publication Data

US 2014/0069330 A1 Mar. 13, 2014

(51) Int. Cl.

| | |
|---|---|
| ***B27K 3/16*** | (2006.01) |
| ***B05D 1/18*** | (2006.01) |
| ***B27K 3/04*** | (2006.01) |
| *B27M 3/14* | (2006.01) |

(52) U.S. Cl.
CPC . *B27K 3/163* (2013.01); *B27K 3/04* (2013.01); *B27M 3/14* (2013.01)

(58) Field of Classification Search
CPC ..... B27K 3/04; B27K 3/163; B27M 3/14
See application file for complete search history.

(56) References Cited

U.S. PATENT DOCUMENTS

| | | | | |
|---|---|---|---|---|
| 5,296,240 | A * | 3/1994 | Palmere et al. | 424/660 |
| 2002/0114895 | A1 * | 8/2002 | Kuntz et al. | 427/430.1 |
| 2004/0166246 | A1 * | 8/2004 | Holcomb | 427/440 |

OTHER PUBLICATIONS

Taylor, Adam and Lloyd, Jeff, "Phytosanitation of railway crossties with a hot borate solution immersion treatment," Forest Prod. J., Apr. 2009, 59(4):76-78, 3 pages.
"Norfolk Southern, RTA Showcase Long-Term Research—Field Trip to 23-Year-Old Test Site Eye-Opening for 50 Wood Tie Industry Members," Crossties, Mar./Apr. 2010, pp. 13-16, 4 pages.
Kim, Jae-Woo, Taylor, Adam, Kose, Coskun, and Lloyd, Jeffrey, "Ambient-temperature borate dip-diffusion treatment of green railroad crossties," International Research Group on Wood Protection, IRG/WP, IRG Secretariat, Stockholm, Sweden, www.irg-wp.com, 11 pages, May 2011.

* cited by examiner

*Primary Examiner* — Dah-Wei D Yuan
*Assistant Examiner* — Kristen A Dagenais
(74) *Attorney, Agent, or Firm* — Lewis Rice LLC

(57) ABSTRACT

Systems and methods are provided for submersion of wood products, specifically stacked railroad crossties, in an ambient temperature and pressure dip such as a borate solution. The systems and methods are designed to provide for treatment of stacked green railroad crossties with a borate solution in a batch methodology as part of a continuous crosstie processing operation for manufacture of such crossties.

9 Claims, 8 Drawing Sheets

TREATMENT TANK FOR WOOD ARTICLES

BACKGROUND OF THE INVENTION

1. Field of the Invention

This disclosure relates to the field of treatment processes for wooden articles, specifically to a tank and system for treating railroad crossties with a thickened borate solution.

2. Description of Related Art

While the vast majority of people are far more familiar with roadways and trucking as part of the transportation infrastructure, there can be no doubt that the railroad is still far from obsolete and in many parts of the world is still a primary form of transportation. While many trains today are small passenger (or light rail) trains that serve cities and provide public transportation, in many respects passenger transportation is a very small percentage of rail transportation. A huge amount of goods still travel by rail. These freight lines (or heavy rail) tracks and trains are still an essential component of the world economy.

Currently, the United States has more than 220,000 miles of railroad track suitable for freight transport and many countries also include a large amount of similar railway. While light rail tracks are typically mounted in concrete to provide for a smoother ride, large freight rail lines, which handle significantly greater load, still utilize traditional wooden crossties (or "sleepers") to support the rails.

The number of wooden crossties in use in the United States, and throughout the world, to support these railways is huge. Every mile of track in the United States has around 3,000 crossties holding it together. Thus, simple maintenance of existing lines, assuming a crosstie can have an operational life of 30 years, creates a need for over 20 million crossties every year.

While wood has a number of beneficial properties for use as crossties including its renewable nature and high load bearing capability (while still being flexible), it has one inherent weakness which is its increased vulnerability to degradation over time compared to alternative materials. In order to help preserve wood crossties (and provide them with the upwards of 30 year useful life which is generally standard) the wooden crossties have for many years been treated with chemicals to inhibit rotting and attacks from wood-eating insects. For the vast part of history, this treatments is with coal-tar creosote.

The processes for treating crossties with creosote are well established and generally involve placing dried crossties in a sealed chamber and exposing them to increased pressure while creosote is introduced in order to force the creosote into the wood cells to provide sufficient saturation. This process is relatively slow, as only a relatively small number of crossties can be simultaneously treated and they often require specific positioning, and is also relatively difficult because of the pressurization requirements. Further, long drying periods of the crossties which are necessary prior to treatment can result in incipient decay prior to treatment and further complicate the process.

Creosote is also a generally unpopular material. It has been labeled as a carcinogen and is generally regarded as toxic by a number of regulatory agencies. Further, over time, it can leach from crossties into soil and related environments which has resulted in environmental concerns from crosstie waste and on railway beds. Further, used crossties, which were a popular building material for retaining walls or similar structures, are growing less popular due to these concerns meaning that more crossties need to be disposed of in landfills or other holding facilities.

It has been proposed that crossties be treated with a borate solution as borates are generally less toxic and easier to handle. Borate treatment, however, has thus far followed the same general treatment patterns as creosote treatment. Crossties are allowed to dry and are then treated under pressure and elevated temperature to insure proper saturation. While some non-pressurized methodologies utilizing higher concentrate "dips" have been proposed, there have been no solutions proposed for how to integrate such treatments into the crosstie manufacturing process.

SUMMARY OF THE INVENTION

For these and other reasons known to those of ordinary skill there are described herein systems and methods designed to provide for ambient temperature and pressure dip-treatment of railroad crossties (sleepers) in Borate solution in a batch process which is complementary to standard crosstie manufacturing techniques. This provides for a borate treated crosstie suitable for use by the railroad industry.

There is described herein, in an embodiment, A system for submerging wood products in an ambient solution, the system comprising: an open-topped tank, the tank including a solution at ambient temperature and pressure; a frame suspended above the tank, the frame including; a plurality of vertical supports each having a top and bottom end; a horizontal support connected to the vertical supports toward the top end; a panel moveable relative to the horizontal support; and a platform connected toward the bottom end of the vertical supports; and a lift mechanism for moving the frame relative to the tank; wherein when wood products are placed on the platform the panel descends on the wood product from above and constrains the wood product between the panel and the platform and wherein, the lift mechanism causes the wood product to descend into the tank only after the wood product is constrained between the panel and the platform.

In an embodiment of the system the wood products comprise a plurality of railroad crossties which are stacked, such as by German stacking.

In an embodiment of the system the solution comprises a 10% or greater borate solution.

In an embodiment of the system the platform includes a conveyor which may move the wood products from the platform to a holding area adjacent to the tank. The holding area may include a sluiceway where borate solution dripping from the wood products is captured and returned to the tank.

In an embodiment of the system the panel comprises a hollow frame.

In an embodiment of the system the panel is raised and lowered by hydraulics.

In an embodiment, the system further comprises a conveying system for placing the wood products on the platform. The wood products may railroad crossties which are stacked, such as by German stacking.

In an embodiment of the system the frame is sized and shaped to allow the wood products to be loaded onto the platform by a fork truck. The wood products may railroad crossties which are stacked, such as by German stacking.

DESCRIPTION OF THE PREFERRED EMBODIMENT(S)

Generally the systems and methods discussed herein will be used to dip-treat wooden railroad crossties (sleepers). Crossties have generally standard dimensions and construction. A railroad crosstie is generally about 7"×9" and 8'6' or 9' long and is constructed as a monolithic piece from various hard woods (red oak, white oak, gum, and hickory are common but many others are also used) or, in some cases, constructed from softwoods. While this application specifically contemplates systems and methods for treating of crossties, which have unique issues due to their size and mass, the processes contemplated herein could be used to treat other wood products as appropriate.

Crossties are generally manufactured in saw mill operations. In order to insure consistent sizing and quality, crossties are generally rough-hewn in a first process at a sawmill and are then converted to finished crossties in a second process at a crosstie processing plant. The second part of the process will generally involve treatment and is therefore discussed here. For purposes of understanding, it needs to be recognized that in the crosstie processing operations, crossties will generally be formed individually (one at a time) with each tie passing through cutting and preparing steps on its own. Once this process is completed, the crossties are essentially complete except for wood treatment. This disclosure provides for a treatment system which is designed to be incorporated at this end stage of crosstie construction. The crossties being discussed herein, therefore, will generally be sized and completely cut, incised to provide for improved absorption, and end-plated (if that is to performed) prior to the processes and systems discussed herein. The crossties will also generally be "green" (undried) at the start of this process and the process presumes a use of green lumber. For purposes of this disclosure, it is generally presumed that green crossties have been stacked immediately prior to the present operations.

Figure 1:
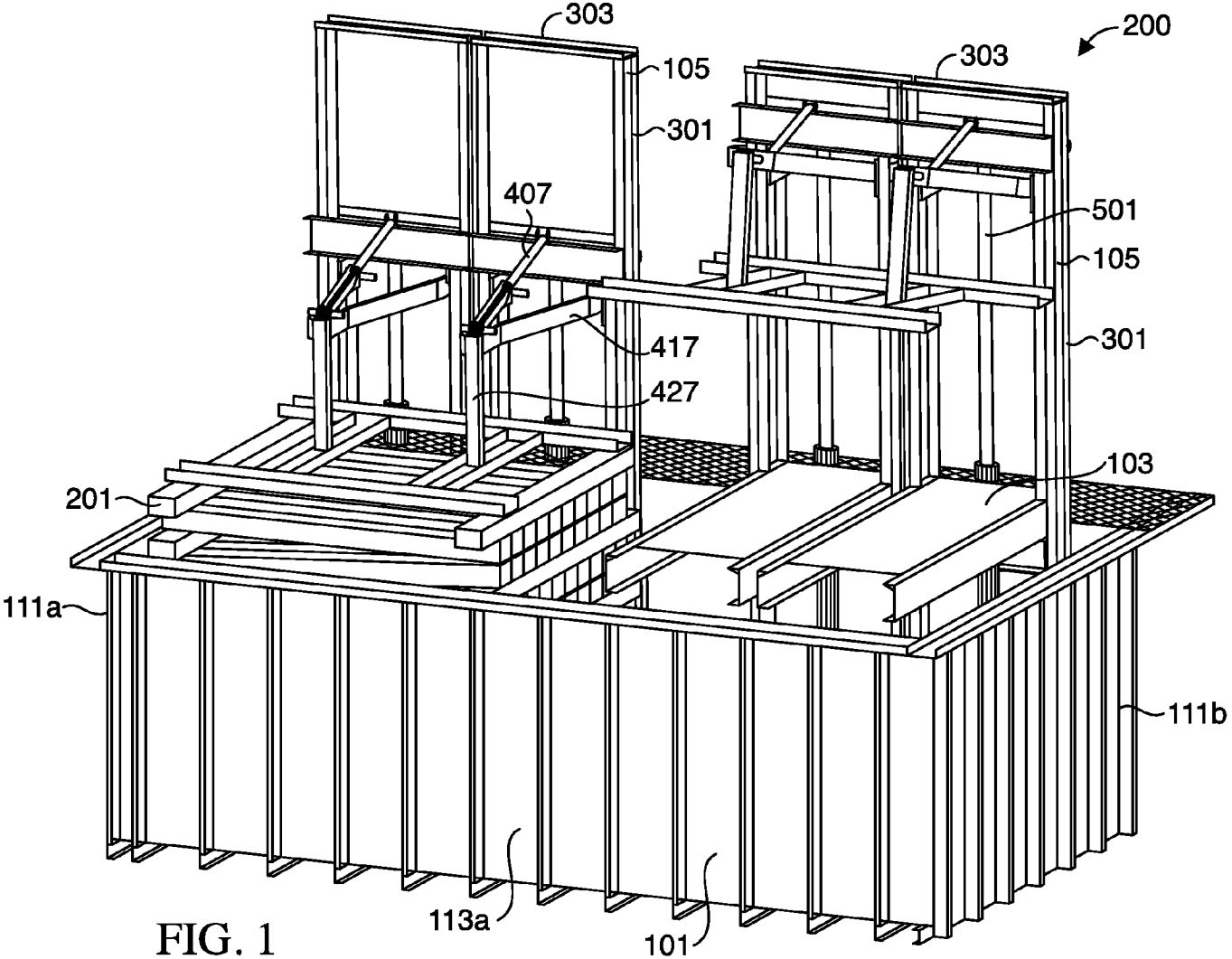
FIG. 1 provides a front perspective view of a first embodiment of a dip tank.
Figure 2:
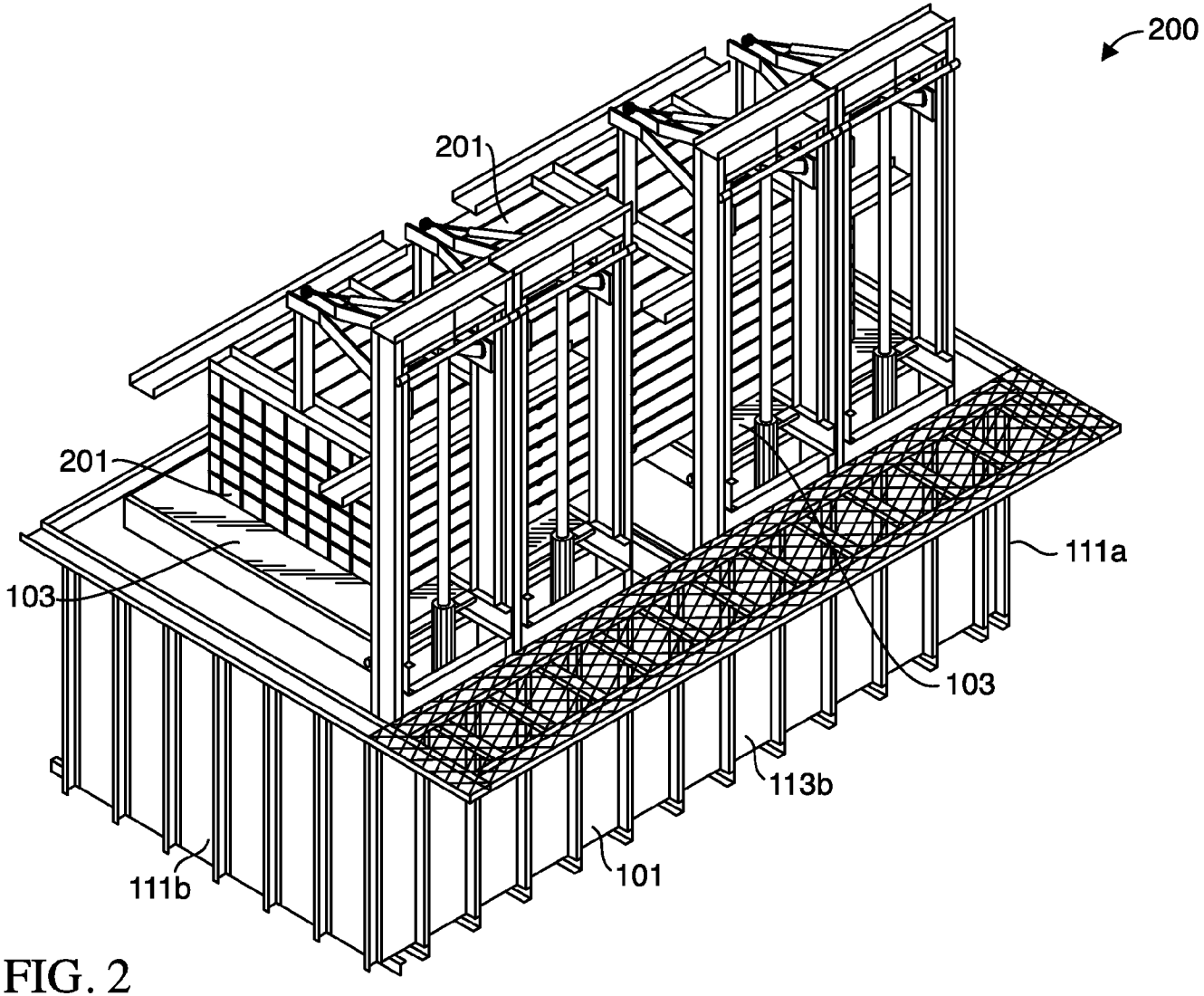
FIG. 2 provides a rear perspective view of the embodiment of FIG. 1.

FIGS. 1-2 show a first embodiment of a dip tank (100) useable for dip treating railroad crossties (201) and similar wood products in solutions. FIGS. 3-7 show a second embodiment of a dip tank (200). Both dip tanks (100) and (200) utilize generally similar construction and common parts are commonly labeled. However, the dip tank (100) provides for a single lowering platform (103) that includes an integral conveyor (133) while the dip tank (200) includes two independent lowering platforms (103). As the dip tank (200) includes two independent platforms (103) it also includes two independent frames (105) to provide for each platform to move independently of the other.

It is expected that both dip tanks (100) and (200) will have their tanks (101) arranged at least partially underground and that the tanks (101) will be filled with a dip solution, which will generally be a borate solution. While any type of borate solution can be used, one such solution is available as Cellu-Treat™ from Nisus Corporation. While dipping in other solutions is contemplated, the dip tanks (100) and (200) discussed herein are particularly designed to be used with ambient dip conditions. That is, the materials in the tank (101) are not placed under pressure conditions and the materials are not at a significantly raised temperature. It is recognized that under certain conditions some heating of the tank (101) may be necessary, for example, if the outside temperature was below freezing and the solution was beginning to gel or thicken. However, these situations will generally utilize heat simple to return the material to about standard temperature and pressure conditions as would be expected in normal operation in a temperate climate.

The FIGS show embodiments of a dip tank (100) or (200) which may be part of crosstie processing plant. The dip tank (200) is designed to provide for dipping of multiple stacked railroad crossties (201) which comprise a single batch load. In this embodiment, the treatment system will be designed to handle at least one, but possibly more stacks of crossties (201) in a single dip treatment. In the embodiment of FIGS. 3-7 the tank (101) is sized and shaped to submerge two standard stacks of crossties (201).

The dip tank (100) is designed to handle two stacks of crossties (201) as well. However, it is designed so that each can be dipped individually. Thus, a batch load in each treatment of dip tank (100) can comprise one or two stacks (201).

The use of stacked crossties (201) during the submersion provides for a number of benefits. As indicated above, the process and system is intended for use as part of a crosstie processing plant. While a crosstie processing plant generally processes a continuous stream of crossties (201), stacking of the crossties (201) generally converts a continuous stream to a batch stream. Specifically, during the time that the crossties (201) are coming off the continuous stream which will make up the stack (201), the stack (201) is generally holding waiting for them and will not move until complete. Thus, while there is a generally continuous flow of stacks (201) coming from the prior operations, the crosstie stacks (201) come out of the operations slower than individual crossties (201) and there is usually a significant time lag between them. Thus, handling of stacked crossties (201), while a continuous process, allows for each crosstie (201) stack to be treated as a batch without significantly slowing the processing.

Stacks provide for a number of benefits of handling of the crossties (201) during the dip process. While the crossties (201) can be treated in a continuous fashion as individual crossties in an alternative embodiment, having the crossties (201) arranged in a stack allows for the crossties (201) to be transported and manipulated in a standard fashion, e.g. via fork truck (203) or automated conveyor systems, as is known to one of ordinary skill in the art. Further, the dip tank (100) or (200) designed for batch, as opposed to continuous, processing can usually operate on a much greater number of crossties (201) simultaneously and provides for better control of submersion of the crossties (201).

The tank (101) shown in the FIGS is generally rectilinear in construction. The tank (101) has two side edges (111*a*) and (111*b*) and two main edges (113*a*) and (113*b*). The tank (101) is filled with fluid which will generally be a borate suspended in water in high concentration. There is at least one platform (103) arranged above the tank (101). In the embodiment of FIGS. 3-7, the platform (103) includes a conveyor (133) which is formed from a plurality of rollers (131) and is designed to convey material thereon in a generally linear direction, in this cases from side edge (111*a*) to side edge (111*b*). In the depicted embodiment, the conveyor (133) includes a standard multi-roller conveyor system which is designed to handle large objects, specifically pallets or crosstie stacks (201).

On the tank (101) there is a frame (105). The frame (105) is generally constructed to have legs (301) which are arranged generally at the corners of the platform (103) which extend vertically above the tank (101). The frame (105) also includes horizontal beams (303) which interconnect the legs (301) at a space raised above the platform (103). This provides for a generally rectilinear frame with openings above at least one side edges (111) and both main edges (113). The horizontal beams (303) may form a roof of the frame (105) as shown in FIG. 3 and additional beams (305) may also be provided as part of the frame (105) to support the panels (401) or to provide additional rigidity to the construction.

The embodiment of FIGS. 3-7 is designed to operate with two different loading modes. In a first mode, the platform (103) may be loaded as part of an automated operation. In this mode, a stack (201) would be created prior to the system (generally via a stacking machine) and would be conveyed to the platform (103) via a horizontal conveying system of a type well known to those of ordinary skill. This arrangement is generally "in-line" where the crosstie stacks (201) would be provided by the conveying system adjacent to a side edge (111*a*) so that the stacks (201) can pass from the conveying system onto the conveyor (133) on the platform (103), where they can then be positioned via conveyor (133) for submersion.

Figure 4:
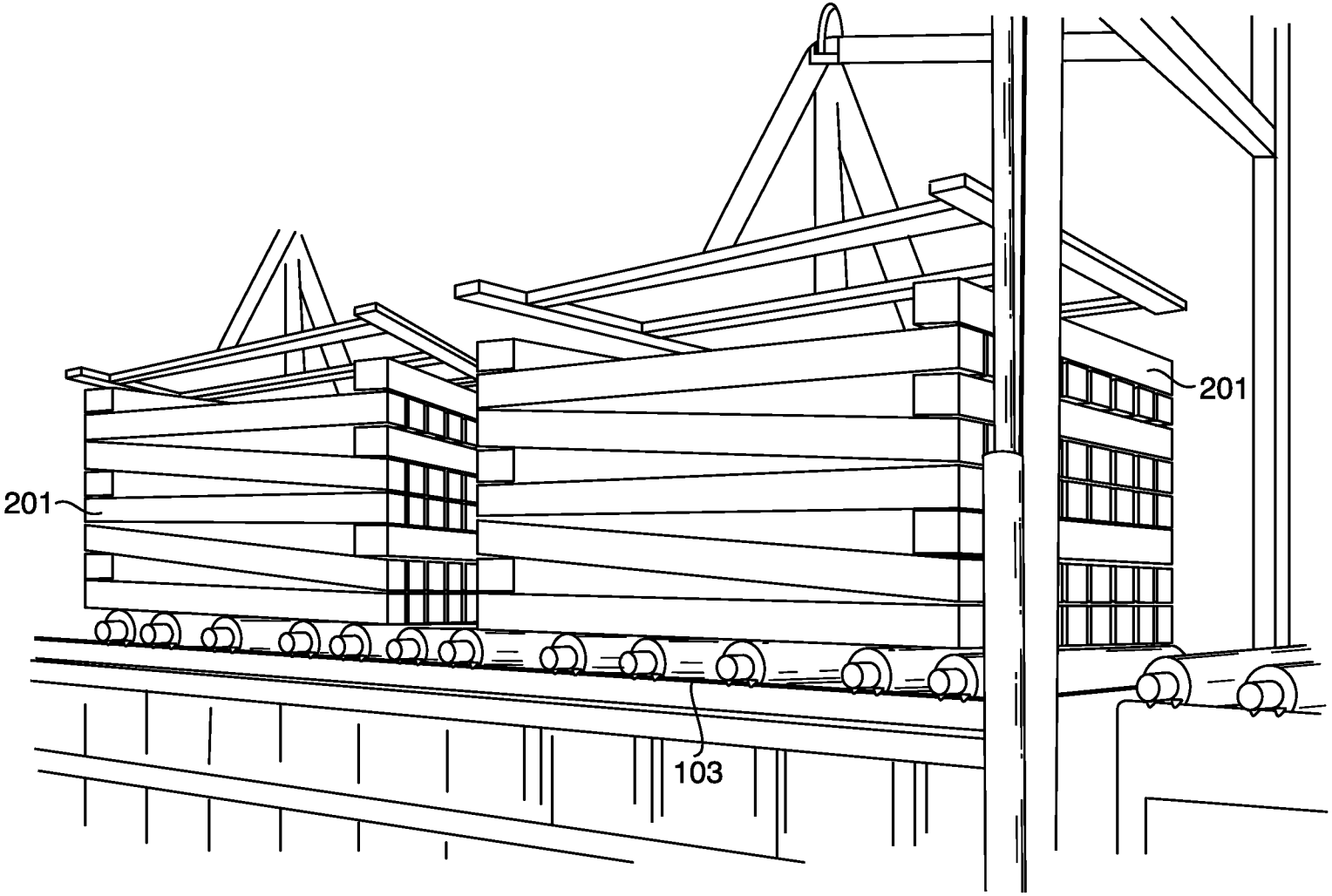
FIG. 4 shows the embodiment of FIG. 3 with two crossties stacks thereon. The first has had the panel lowered while the second has not.

As this tank (200) is designed to submerge two stacks (201) simultaneously, the stacks (201) would generally be corralled prior to the tank (200), if necessary, and the first two stacks (201) would be provided onto the platform (103) in the same operation. Alternatively, each stack (201) may be positioned at or around the time it arrives at the platform (103). Such operation, however, would generally require finer control over the positioning of stacks (201) on the platform (103) (e.g. the rollers (131) would each need to move independently of the other) which would likely increase cost. After the stacks (201) have been loaded onto the platform (103), they will generally be positioned as shown in FIG. 2 or 4.

Figure 3:
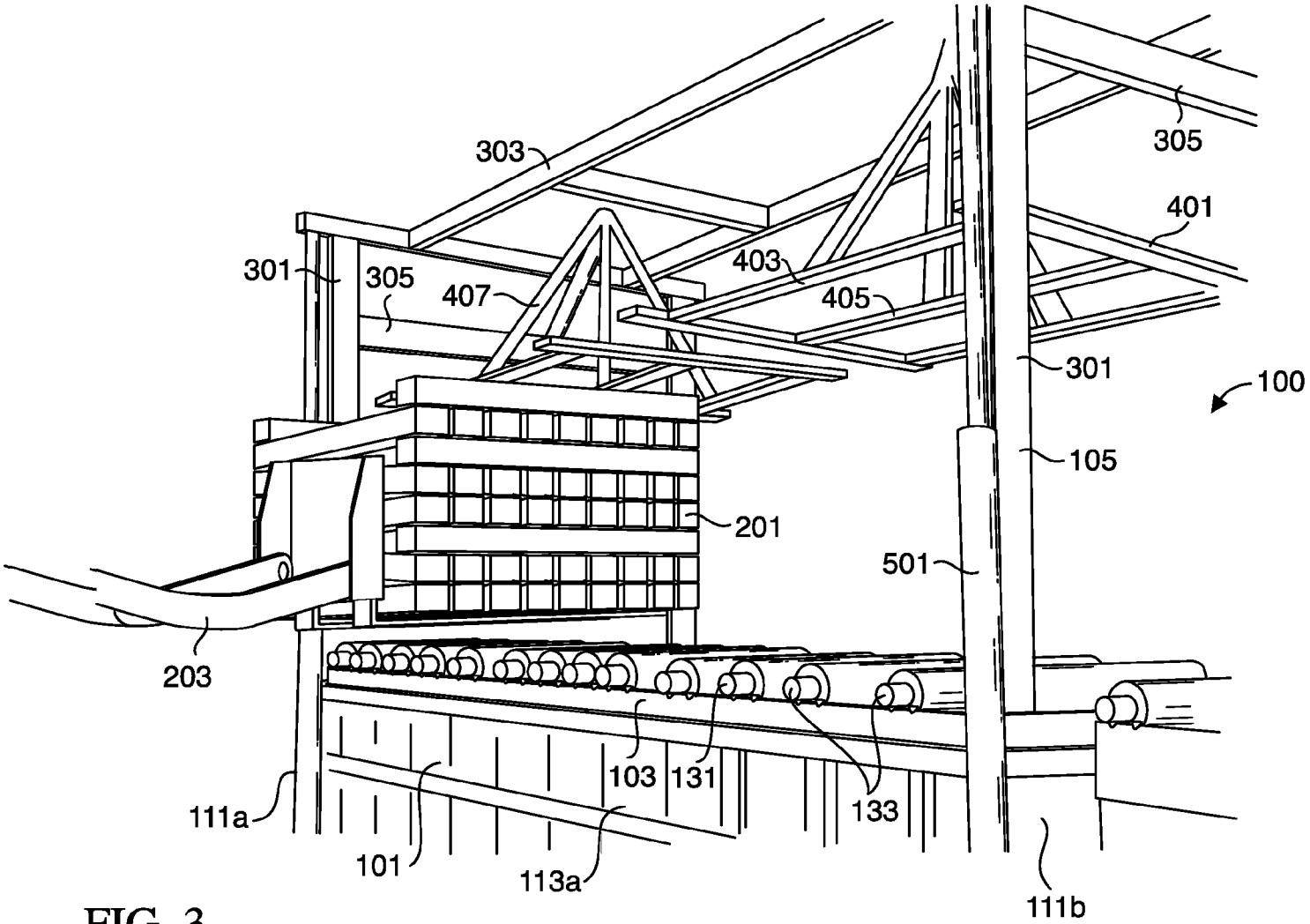
FIG. 3 provides a front perspective view of a second embodiment of a dip tank as it is being loaded with a stack of crossties by a fork truck.

The embodiment of FIGS. 3-7, and the embodiment of FIGS. 1 and 2, can alternatively be loaded as part of a non-automated operation and may be loaded by a fork truck (203), crane, or related piece of machinery. In this case the stacking may again occur by automated stacking machines, or, more likely, the crossties (201) will be manually or semi-manually stacked. It is important to note that regardless of how the stacks (201) are formed, the stacks (201) are not dried prior to being provided to the tank (100), and the stacks (201) comprise green crossties (201). The tank (100) is designed to be manually loaded from the front (over main edge (113*a*)) in this operation as this allows for such operation even if conveying systems are in place for automated batch running Thus, should an automated conveying system have a problem, stacks of crossties (201) can continue to be loaded and treated. In FIG. 3, the dip tank (100) is being shown loaded by a fork truck (203) in accordance with this method of loading.

As discussed above, the tank (101) will generally include a borate dip material. This will generally comprise a concentrated borate mixture. The borates will generally be suspended in water in thickened concentration. Specifically, the formulation will generally comprise 20% or greater borate concentration. In a preferred embodiment, the concentration of borate is greater than 20% but less than 30% so as not to produce significant caking of borates on the surface of the ties during and after drying and so as not to put more borate in the tie than is needed for effective treatment. In alternative embodiments this amount can be between about 20% and about 27%, about 20% and about 25%, or about 22%.

It should be noted that the tank (101) may include mixing or circulation apparatus in order to inhibit the borates from settling in the bottom of the tank (101). However, for purposes of the treatment, such circulation, mixing, agitation, or pumping is generally unnecessary during the treatment process and circulation will generally not be used to insure borate contact with the crossties (201) during treatment. Instead the tank (101) is generally an ambient dunk tank where the crossties (201) are simply submerged without pressure or temperature raise, or need for circulation. Vessels requiring raised temperature and pressure often require controlled environments for operation which can inhibit the treatment of crossties (201) in a standard automated operation. Therefore, it is preferable that the tank (101) simply contain an ambient liquid pool at about standard temperature and pressure.

In the embodiments of the FIGS, the dip tank (100) or (200) is designed to provide for simultaneously loading of two stacks of crossties (201). This is shown in FIGS. 2 and 4. The crosstie stacks (201) are arranged side by side and the stacks show the crossties (201) German stacked as that term is understood by one of ordinary skill. While German stacking is not required and the crossties (201) may alternatively be treated individually or in other stacks or combinations, German stacking is generally preferred for two reasons. In the first instance, as the crossties (201) can be treated while green, after the treating process is complete the crossties (201) can be left in the dipped stacks for drying. In this way there is no need to stack or restack wet crossties (201) after treatment. This eliminates an additional step and more labor as well as additional time. It also inhibits workers from having to handle treated crossties (201) prior to drying or run treated crossties (201) through stacking machines that are often more suited to handling dry crossties (201).

As the treated crossties (201) will usually have a slickened surface, this can be a safer manner of operation. Further, the German stacking also provides for increased surface area to all crossties (201) in the stack, which improves the contact of the crossties (201) in the stack with the borate in the tank (100). In effect, the ability of the stack (201) to obtain air flow, also improves fluid flow to the crossties (201) and results in a solid treatment akin to treating the crossties (201) individually.

Regardless of the methodology for getting the crossties (201) on the platform, once a full load of stacks of crossties (201) is on the platform (103), it is ready for treatment. Generally the platform (103) itself will be capable of sinking into the borate treatment to treat the crossties (201). As the crossties (201) are wood, the crossties (201) will have a propensity to float as the borate treatment includes a large percentage of water in order to suspend the borates. For this reason, the system also includes a clamp panel (401) which is designed to support the crosstie stacks (201) during the submersion.

While in an embodiment it is possible to hold the crosstie (201) stack submerged using a relatively small clamp panel (401) across the top of the crosstie (201) stack because the German stacking results in top beams arranged to hold the rest in place which serve to effectively pinch the stack and keep underlying beams from floating (see e.g. the stack in FIG. 3 where a single beam from generally left to right would hold the stack), it has been determined that a more direct support is actually beneficial and provides for better soak.

Specifically, as can be best seen in FIGS. 1, 3, 4 and 7, the vertical support (105) supports at least one clamp panel (401) which is generally the same size as the footprint of the crosstie stack (201). This allows for the panel (401) to contact the four corners of the stack and aid in submersion. The panel (401), by contacting all four corners, provides for a more rigid sandwiching of the stack (201) which has been found to inhibit any shifting of the stack or crossties (201) within the stack and thus provide a more controlled submersion positioning while still allowing the suspended borate to contact virtually the entire surface area of all the crossties (201) in the stack.

In order to minimize contact between the panel (401) and the stack (201), and therefore reduce points where the borate solution cannot contact the stack (201) directly, the panel (401) in FIG. 1 comprises a generally quadrilateral frame (403) with a center support beam (405). The beam (405) serves to both inhibit twisting of the panel (401), and also as a connection point to attach the lift (407). In alternative panels (401) the panel (401) could be a grid, a wireframe, or another structure which includes voids to attempt to minimize contact. While contact minimization is generally desirable, it should be recognized that points of contact are not necessarily bad. In the first instance, as the contact is likely not watertight, the borate solution can at least partially flow between the panel (401) and the stack (201). Secondly, the borate solution can still penetrate an area in contact with the panel (401) via standard moisture penetration processes in wood.

Figure 5:
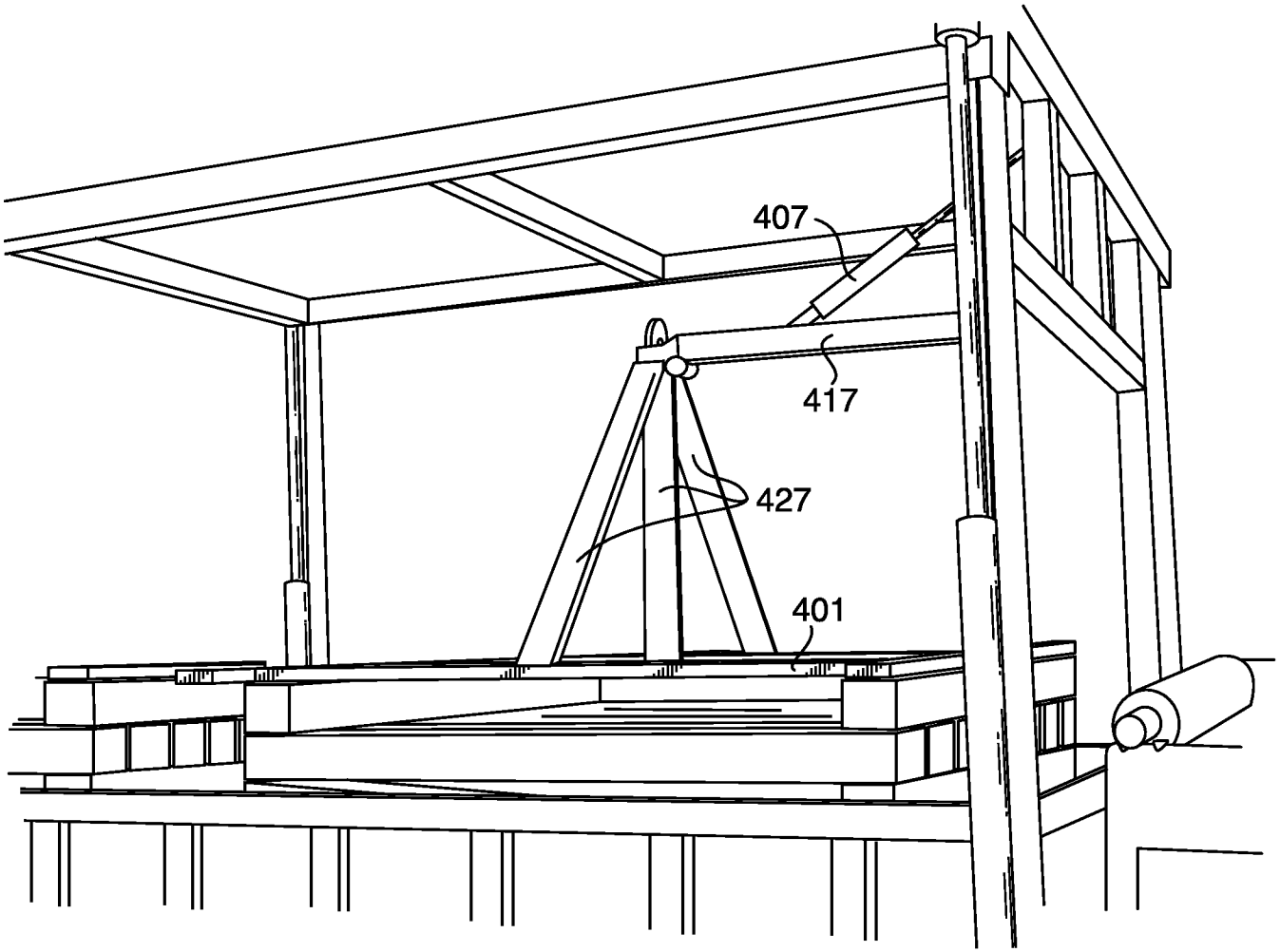
FIG. 5 shows the embodiment of FIG. 4 with the crosstie stacks partially lowered into the tank.
Figure 7:
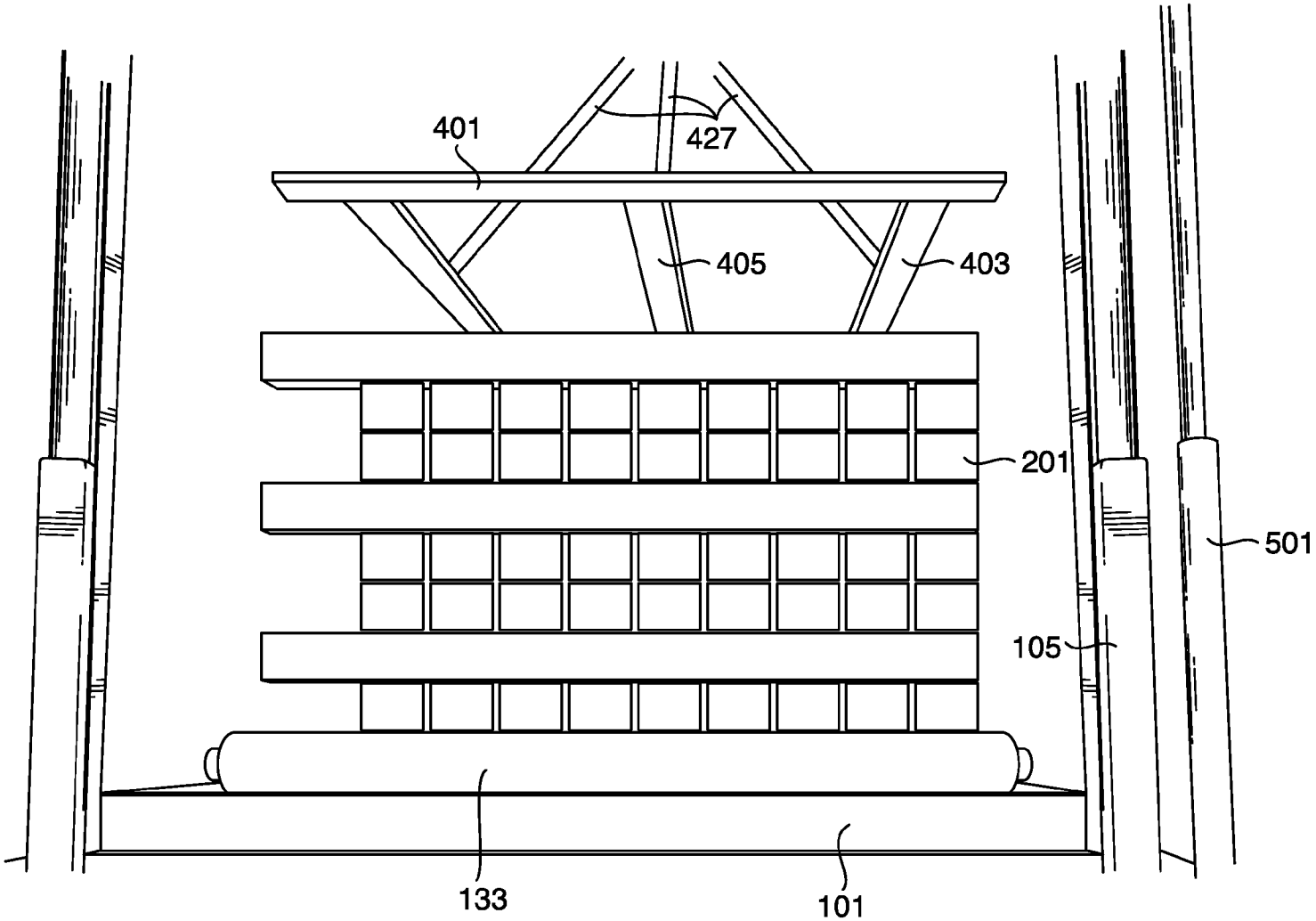
FIG. 7 provides a side view of the embodiment of FIG. 3.

As best seen in FIGS. 5 and 7, The panel (401) is moved relative to the remaining frame by a lift mechanism (407), which in the depicted embodiment is a hydraulic cylinder, however other mechanisms such as, but not limited to, mechanical winches or pneumatic cylinders may be used in alternative embodiments. The panel (401) is generally attached to the lift (407) by an overhead support arm (417) positioned above the panel (401) at or near its center (and its center of gravity). The support arm (417) is then attached to the panel (401) by one or more leveling arms (427). The leveling arms (427) are generally designed to provide some rigidity to the connecting and inhibit the panel from freely swinging or tilting its major plane. This can assist in keeping the stack (201) from shifting. However, it is preferred that the panel (401) not be rigidly attached and be allowed some swing or play in the attachment. In this way, as the lift mechanism (407) lowers the panel (401), the panel (401) will generally be able to self-orient to contact the stack (201). Thus, stacks (201) of slightly different height or spacing can be accommodated.

Figure 8B:
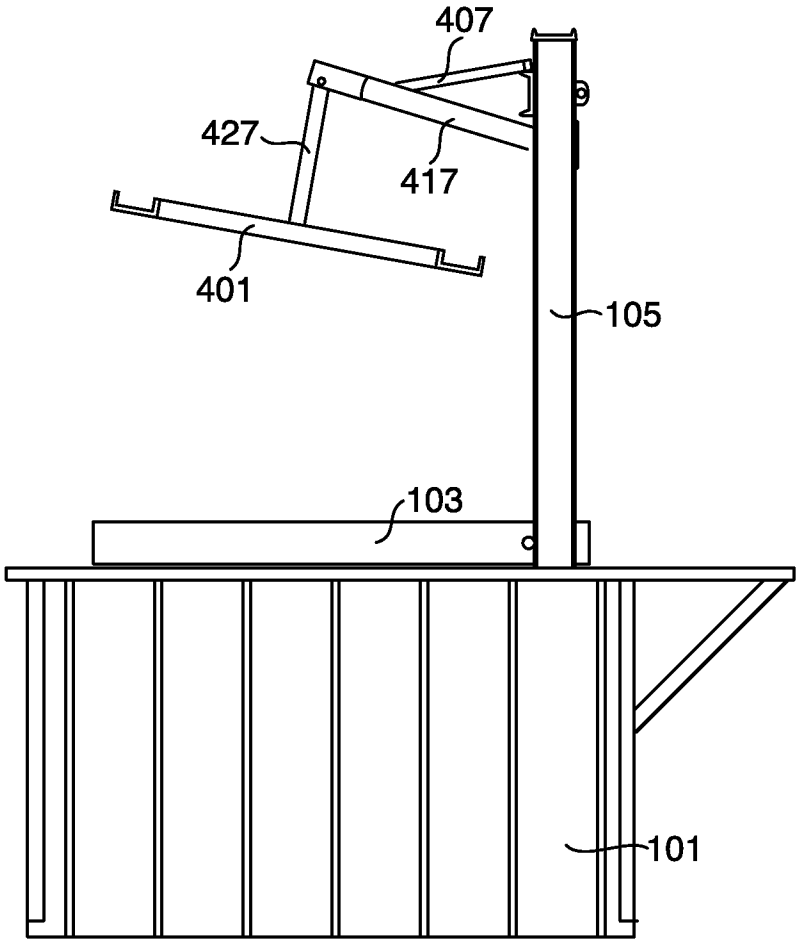
FIG. 8 provides an alternative view of how to pinch the stacks to the platform with FIG. 8A showing the stacks positioned and FIG. 8B showing the system in position for loading.
Figure 8A:
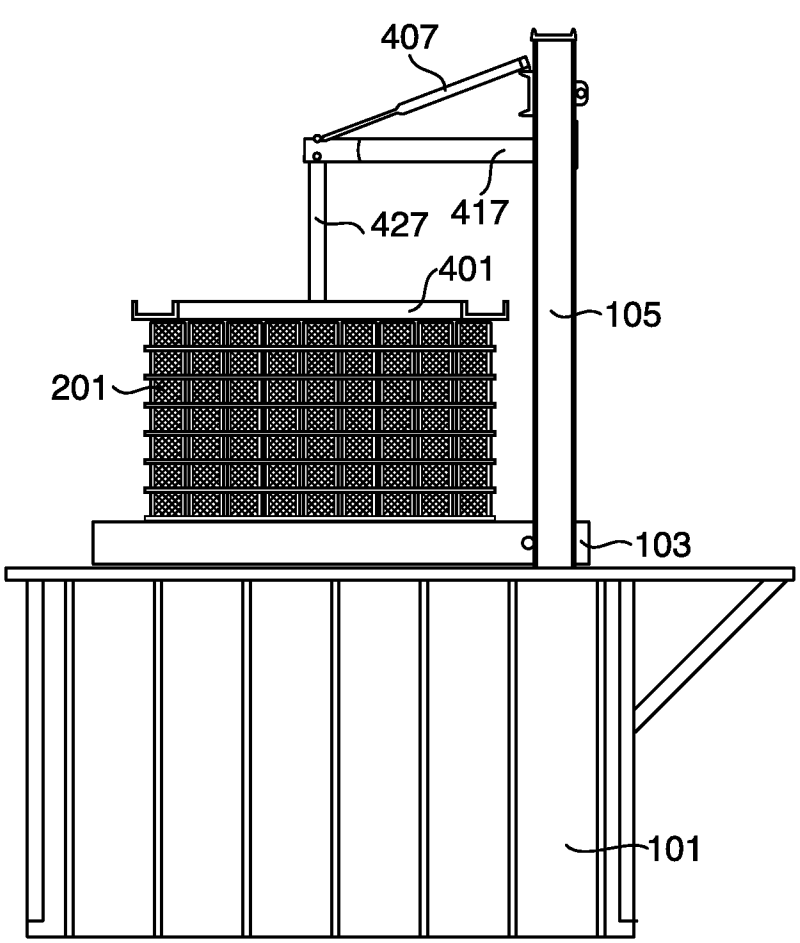

In the embodiment of FIGS. 5 and 7, the play in the motion is designed to be primarily in the one dimension along the line of movement of the panel (401) and generally perpendicular to the two crossties (201) at the top of the stack to provide rigidity in the opposing direction. Once contact has been made between the panel (401) and the stack (201), continued actuation of the lift (407) serves to provide downward pressure to hold the stack (201) on the platform (103) by pinning the stack (201) between the platform (103) and the panel (401). FIG. 8A shows an alternative methodology for pinning the stacks (201) with the panel in the raised (ready to load) position in FIG. 8B.

Once the stacks (201) have been positioned and the panels (401) are in place, the submersion operation will generally begin. As can be best seen in FIG. 5, submersion generally involves the entire frame (105) descending into the tank (101). This methodology is generally preferred as it allows for a fairly rigid support of the stacks (201) throughout the submersion operation as all components in contact with them move. The submersion will continue until the stacks are completely submerged. Submersion may occur by having the frame (105) and platform (103) supported on hydraulic or pneumatic cylinders (501), or another elevation system, which allows them to move relative to the tank (101). Depending on embodiment, the elevation system (501) may be inside or outside the tank (101) to provide for protection of such components.

It is possible that during the submersion operation the tank (101) will overflow due to the submersion, for example if it was overfilled or if the tank (101) was exposed to outside elements and therefore may be higher than normal due to rainwater or other environmental water being therein. To deal with this scenario, the tank (101) may, therefore, include an overflow capture (not shown) which can be used to retain the solution for future return to the tank (101). The solution so captured may be pumped back into the tank (101) at any time, or could be allowed to evaporate harvesting the borate condensate for reuse. As the solution is at ambient temperature and pressure, and is effectively exposed to the elements, there is an advantage that contaminants are of little to no concern.

Once submersion is complete, the stacks (201) will remain submerged until a specified treatment time, generally a couple of minutes, is complete. During the time of submersion, the solution will generally not be agitated or otherwise flowed around the stacks (201), however agitation may be present in other embodiments. Agitation is generally undesirable as is it both an increased cost, and can serve to potentially dislodge all or part of the one of the stacks (201) if sufficiently strong. Instead, the solution in the tank (101) is generally simply ambient and exposure is provided by standard contact with the borate suspended in the solution and the stacking methodology.

Because the solution may be a thick borate solution, e.g. one having 20% or greater borate concentration, there can be some concern that borates may, over time, settle in the tank (101). If the tank (101) is in continuous or semi-continuous operation, the movement of the frame (105), platform (103), and stacks (201) is likely to provide sufficient motion to maintain the mixture in its desired state of suspension. Similarly, operations to replenish the solution which has been used (as both borates and the suspension water will exit the tank (101) with the treated crossties (201)) can serve to stir the solution. In an embodiment, such refilling operation may be provided by having the input of additional solution be at a low level (at or near the bottom of the tank (101)) to enhance the stirring effect. The fluid motion of new solution addition can therefore serve to stir the solution already present and suspend any precipitated solids without need to agitate the solution during the submersion operation.

Once the treatment time is complete, the process of submersion will reverse and the frame (105) and platform (103) will rise to remove the stacks (201) from the tank (101). Once the stacks (201) are returned to their starting point, the stacks (201) may be allowed to drip for a period of time over the tank (101) to remove excess material. After this has completed, the panels (401) will rise freeing the stacks (201). The stacks (201) can then be removed by fork truck (203), or, in a preferred arrangement, the conveyor (133) in the platform (103) will convey the stacks off the side and to a holding area (601).

Figure 6:
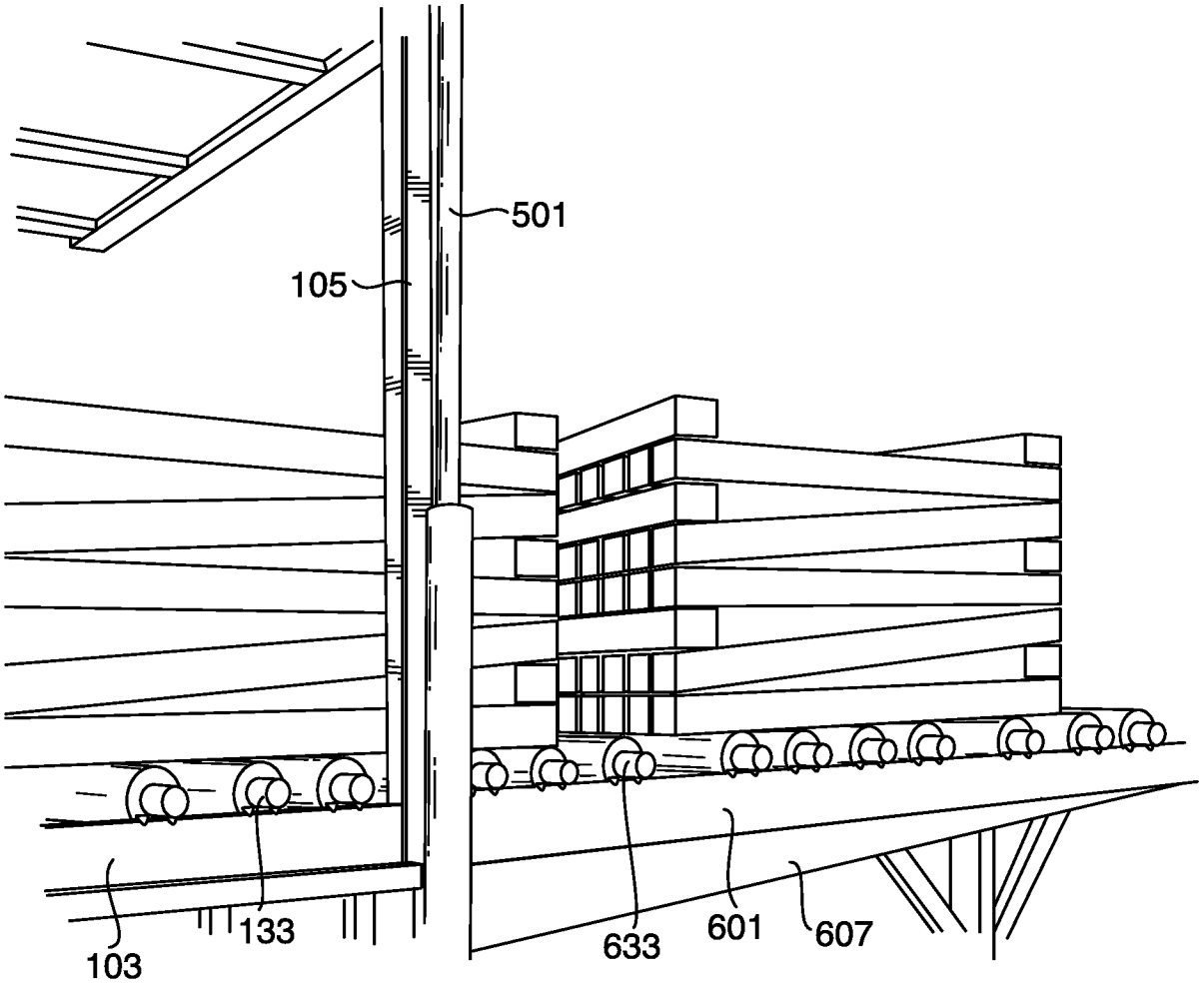
FIG. 6 shows the crosstie stacks of FIG. 4 being conveyed onto a holding platform.

An embodiment of such a transfer is shown, in progress, in FIG. 6. In this embodiment, the conveyor (133) is passing the stacks (201) to a mating conveyor (633) in the holding area (601). As the stacks (201) will generally be very wet and may still be dripping, the holding area (601) will often include a sluiceway (603) underneath it which can act to catch dripped matter and other runoff and return it to the tank (101) for reuse.

The use of a holding area (601) is preferred as it allows for sufficient drip drying while still allowing the platform (103) to be loaded with a new batch of stacks (201). This can provide for a near continuous effective operation of the batch process dunk. Specifically, the stacks (201) can be being created and held prior to the tank (101) while a batch of stacks (201) is submerged in the tank (101) and another group is drying on the holding area (601). The drying stacks (201) can be removed prior to those in the tank (101) needing to move to the holding area (601), and once the stacks (201) have moved from the tank (101) to the holding area (601), the next batch of stacks (201) can be ready for loading.

After the stacks (201) in the holding area (601) are sufficiently dry, they will be removed from the holding area (601) either by automatic conveying, or by fork truck (203). As they have been fully treated at this point in time the stacks (201) will generally be storage stacked at this point and allowed to fully dry until they are ready for distribution to an end user.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A method for treating wood products comprising:

providing a plurality of wood products having two opposing ends;

providing an open-topped tank having therein a treating liquid at ambient temperature and pressure;

providing a clamp panel suspended above said tank, said clamp panel having two opposing clamp boards, each one of said two opposing clamp boards having two opposing ends, said two opposing clamp boards being rigidly disposed on said clamp panel with a crossbeam extending therebetween and connected to each of said clamp boards at about, said crossbeam being movably attached to a frame and said opposing ends of said two opposing clamp boards being four corners of said clamp panel;

placing said plurality of wood products in a German stack, said German stack having a top end comprising two wood products in said plurality of wood products disposed on opposing edges of said top end, said two opposing ends of said two opposing wood products in said German stack being four corners of said top end of said German stack;

pressing said clamp panel against said top end such that said four corners of said clamp panel contact said four corners of said German stack, applying downward pressure on said German stack and inhibiting shifting of said German stack;

submerging said German stack in said treating liquid;

during said submerging step, maintain said downward pressure on said German stack with said clamp panel and thereby stabilizing said German stack in said treating liquid.

2. The method of claim 1 wherein said wood products comprise railroad crossties.

3. The method of claim 1 wherein said treating liquid comprises a borate solution.

4. The method of claim 3 wherein said borate solution comprises a 20% or greater borate.

5. The method of claim 1 wherein said treating liquid comprises a borate suspension.

6. The method of claim 5 wherein said borate suspension comprises a 20% for greater borate.

7. The method of claim 1 further comprising:

after said submerging step, conveying said wood products to a holding area adjacent to said tank.

8. The method of claim 7, wherein said holding area includes a sluiceway where treatment solution dripping from said wood products is captured and returned to said tank.

9. The method of claim 1 further comprising a conveying system for placing said wood products on said platform.

* * * * *